US007242364B2

(12) United States Patent
Ranta

(10) Patent No.: US 7,242,364 B2
(45) Date of Patent: Jul. 10, 2007

(54) DUAL-RESONANT ANTENNA

(75) Inventor: Tero Ranta, Turku (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/238,438

(22) Filed: Sep. 29, 2005

(65) Prior Publication Data

US 2007/0069957 A1 Mar. 29, 2007

(51) Int. Cl.
*H01Q 1/50* (2006.01)

(52) U.S. Cl. ..... 343/860; 343/861; 343/702

(58) Field of Classification Search ..... 343/860, 343/861, 702

See application file for complete search history.

(56) References Cited

U.S. PATENT DOCUMENTS

| | | | | |
|---|---|---|---|---|
| 5,604,507 | A * | 2/1997 | Openlander | 343/860 |
| 6,462,716 | B1 * | 10/2002 | Kushihi | 343/860 |
| 6,717,551 | B1 | 4/2004 | Desclos et al. | |
| 7,088,307 | B2 * | 8/2006 | Imaizumi | 343/860 |
| 2002/0118075 | A1 * | 8/2002 | Ohwada et al. | 333/32 |
| 2003/0174092 | A1 | 9/2003 | Sullivan et al. | |
| 2004/0090371 | A1 | 5/2004 | Rossman | |
| 2006/0055606 | A1 * | 3/2006 | Boyle | 343/702 |
| 2006/0197711 | A1 * | 9/2006 | Sekiguchi et al. | 343/745 |

OTHER PUBLICATIONS

IEEE Transactions on Antennas and Propagation, vol. 50, No. 10; Vainkainen et al.; "Resonator-Based Analysis of the Combination of Mobile Handset Antenna and Chassis"; pp. 1433-1444; Oct. 2002.
IEEE 0-7803-3157-5/96; Haapala et al.; "Dual Frequency Helical Antennas for Handsets"; pp. 336-338; 1996.

* cited by examiner

*Primary Examiner*—Hoang V. Nguyen
(74) *Attorney, Agent, or Firm*—Ware, Fressola, Van Der Sluys & Adolphson LLP

(57) ABSTRACT

A wide-band antenna comprises a series-resonant antenna and a resonant circuit. The antenna has a radiative element and a feed pin. The resonant circuit comprises an inductive element connected to the feed pin and a capacitor connected in parallel to the inductive element, which has a center tap for adjusting the impedance of the resonant circuit relative to the antenna impedance. The antenna can be a low-impedance PILA, a helix, monopole, whip, stub or loop antenna. The wide-band antenna can be used for the low (1 GHz range) or high (2 GHz range) band. The antenna can be made to simultaneously cover both 850 & 900 bands with the ground plane small enough to be implemented in a mobile phone or the like. The center tap is either connected to the feed of the antenna or connected to an RF front-end dependent upon the impedance level of the antenna element.

22 Claims, 12 Drawing Sheets

$$L = \frac{R_{Ant} \cdot VSWR_A \cdot VSWR_B}{Q_{Ant} \cdot 2\pi F_{Res}}$$

$$C = \frac{1}{(2\pi F_{Res})^2 L}$$

$$Tap = \sqrt{\frac{Z_0 / VSWR_A}{R_{Ant}}}$$

DUAL-RESONANT ANTENNA

FIELD OF THE INVENTION

The present invention generally relates to a mobile phone antenna and, more particularly, to wide-band antennas whose bandwidth is increased by a resonant circuit.

BACKGROUND OF THE INVENTION

Typical 50 ohm low-band (850 & 900) planar inverted-F antennas (PIFAs) used in mobile phones have a single resonance and, consequently, a low bandwidth in the order of 50–60 MHz. Standard PIFA implementations are not capable of simultaneously covering both 850 band and 900 band (with a total required bandwidth of 136 MHz, from 824 MHz to 960 MHz). Available bandwidth could be increased by using a longer ground-plane or a higher antenna, but in most cases the ground plane length is limited to 100 mm and the antenna should be no higher than 5–6 mm. In these cases, getting enough bandwidth for both 850 and 900 is not possible without the use of load switching, for example. In 2 GHz area, it is possible to use a parasitic element in standard PIFA implementations to achieve dual-resonance. However, it is not feasible to use a parasitic element for the 1 GHz range because a much larger parasitic element is needed.

Thus, it is advantageous and desirable to provide a wide-band antenna for use in a mobile phone to cover both 850 band and 900 band, preferably from 824 MHz to 960 MHz.

SUMMARY OF THE INVENTION

The present invention uses a resonant circuit that has an impedance level transformation property together with a series-resonant antenna of any type to create a wide-band antenna with user-definable impedance behavior. This matching network is hereafter referred to as the tapped-resonator circuit. The antenna can be a low-impedance planar inverted-L antenna (PILA) that has only a single feed and no grounding pin. The antenna can also be a helix, monopole, whip, stub or loop antenna. The antenna can, in fact, be any type, but it needs to have a series-resonance on the center frequency. If the physical dimensions of the antenna are such that it is not series-resonant, an additional inductor, capacitor or transmission line can be used in series with the antenna to electrically lengthen or shorten it so as to have a series resonance at the point where the matching circuit is located. If the impedance level of the antenna element on the series-resonant frequency is higher than the desired impedance level of the antenna and matching circuit combination, the matching circuit topology can be "inverted". This allows the matching network to match a high or low impedance antenna element to have the desired impedance characteristics independent of the impedance level of the antenna element itself. Such a matching network is said to have an impedance transformation property. The matching network allows the user to design the antenna impedance behavior substantially with full freedom independently of the antenna element type. In addition, the bandwidth of the series-resonant antenna element is increased ideally by up to about 2.8 times with the addition of a second resonance by the resonant property of the matching circuit.

The limitation of this topology is that only one series resonance of the antenna element can be utilized with the shown simple topology. However, this limitation may be overcome by the addition of tunable components (e.g. tunable resonator capacitor) into the matching network. In practice this means that a dual-band (e.g. 1 GHz band and 2 GHz band) antenna element where the bands are formed by separate series resonances cannot be used. Thus the architecture of the mobile phone must be such that a separate antenna is used for the 1 GHz (850 & 900 band) and 2 GHz (1800, 1900 & 2100 bands) ranges. This topology is also suited for a single-band antenna, such as a separate WCDMA, WLAN or BT antenna.

As an example, a single antenna can be made to simultaneously cover both 850 & 900 bands with the ground plane small enough to be implemented in a mobile phone or the like.

DETAILED DESCRIPTION OF THE INVENTION

Figure 1A:
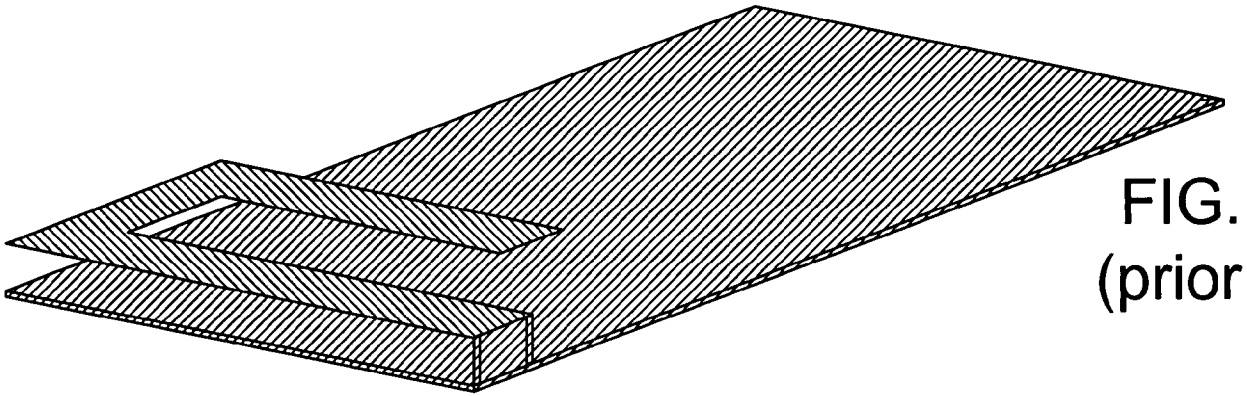
FIG. 1a (prior art)
FIG. 1*a* shows a prior art planar inverted-F antenna (PIFA)
Figure 2A:
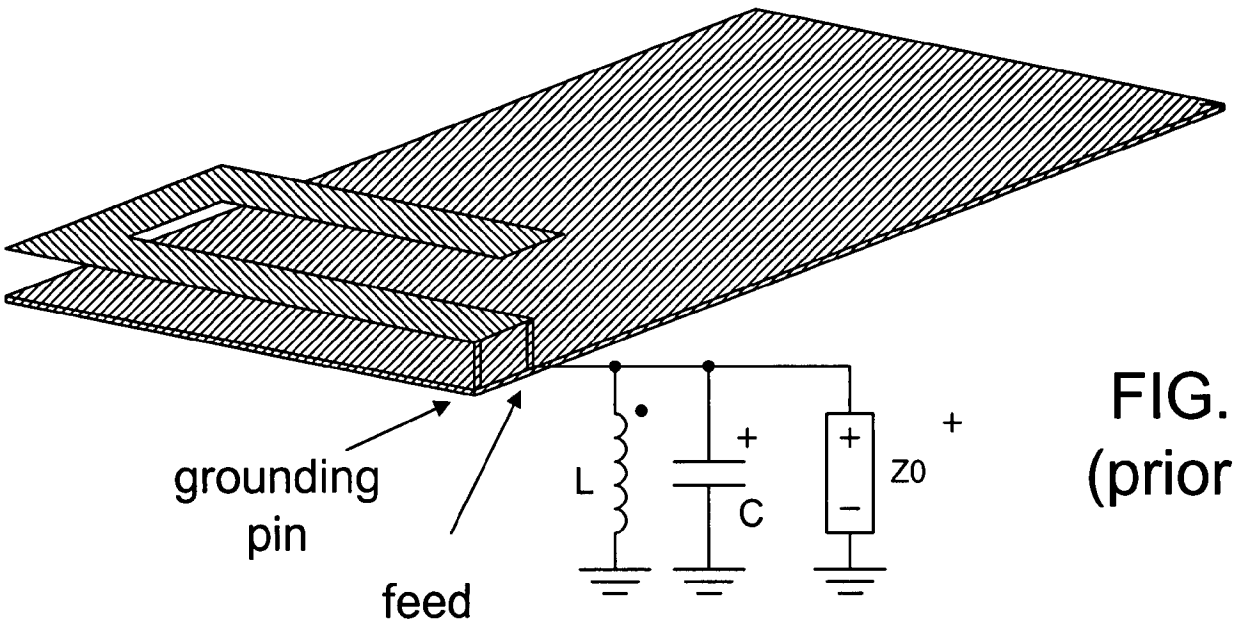
FIG. 2a (prior art)
FIG. 2*a* is a schematic representation of a modified PIFA with a parallel resonant network.
Figure 1B:
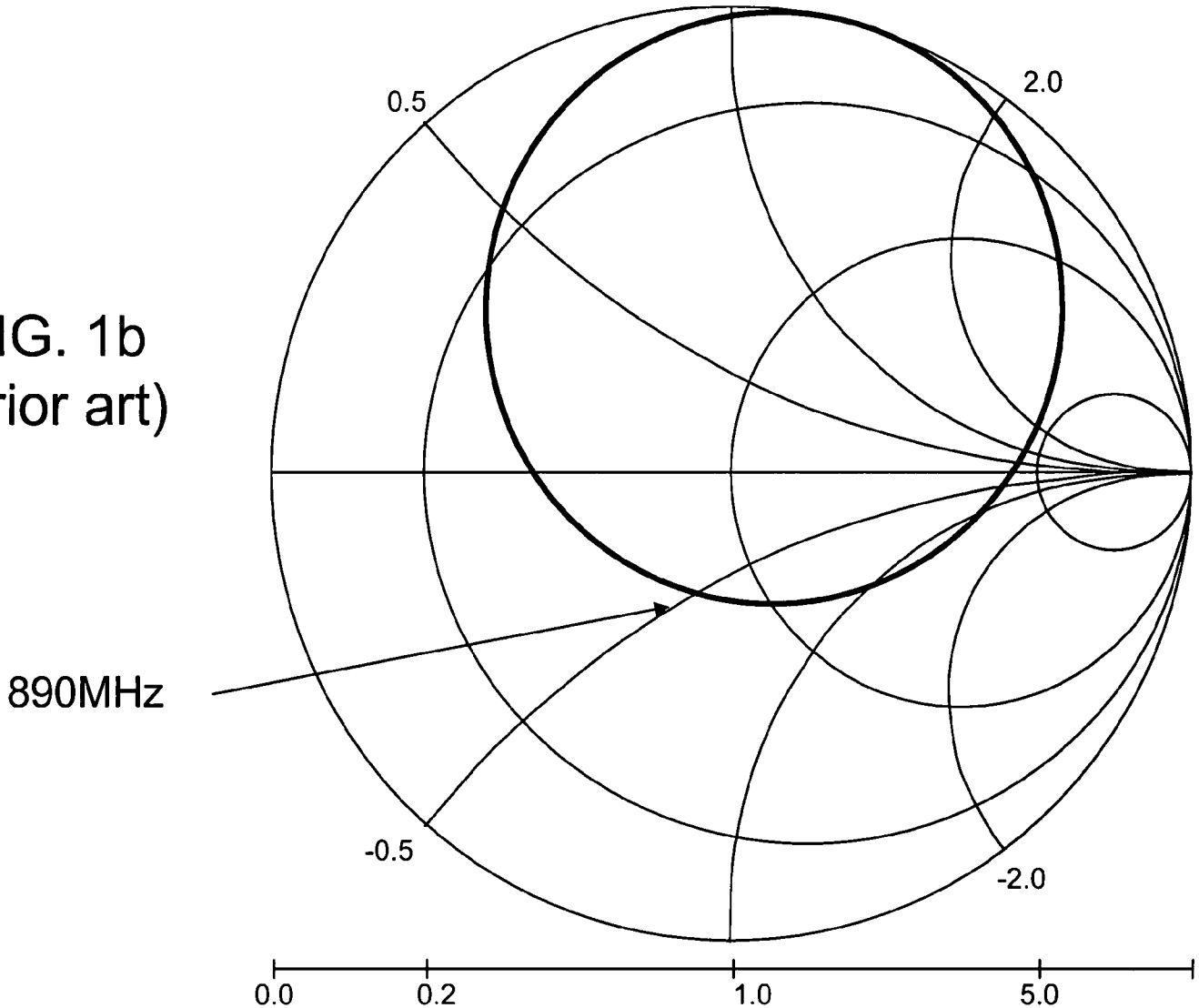
FIG. 1b (prior art)
FIG. 1*b* shows a typical response of a PIFA plotted on a Smith Chart.
Figure 2B:
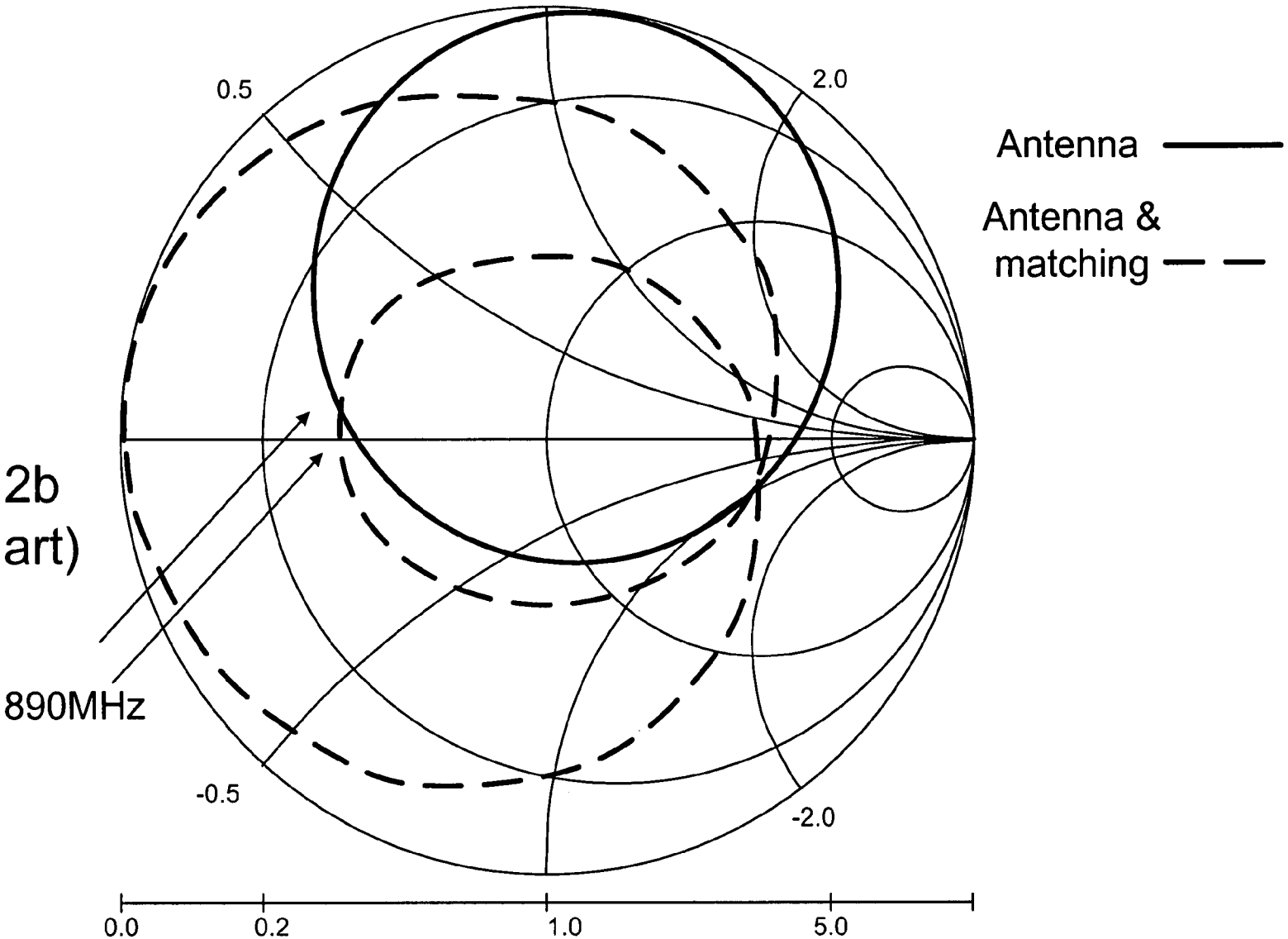
FIG. 2b (prior art)
FIG. 2*b* shows a typical response of a modified PIFA plotted on a Smith Chart.
Figure 3:
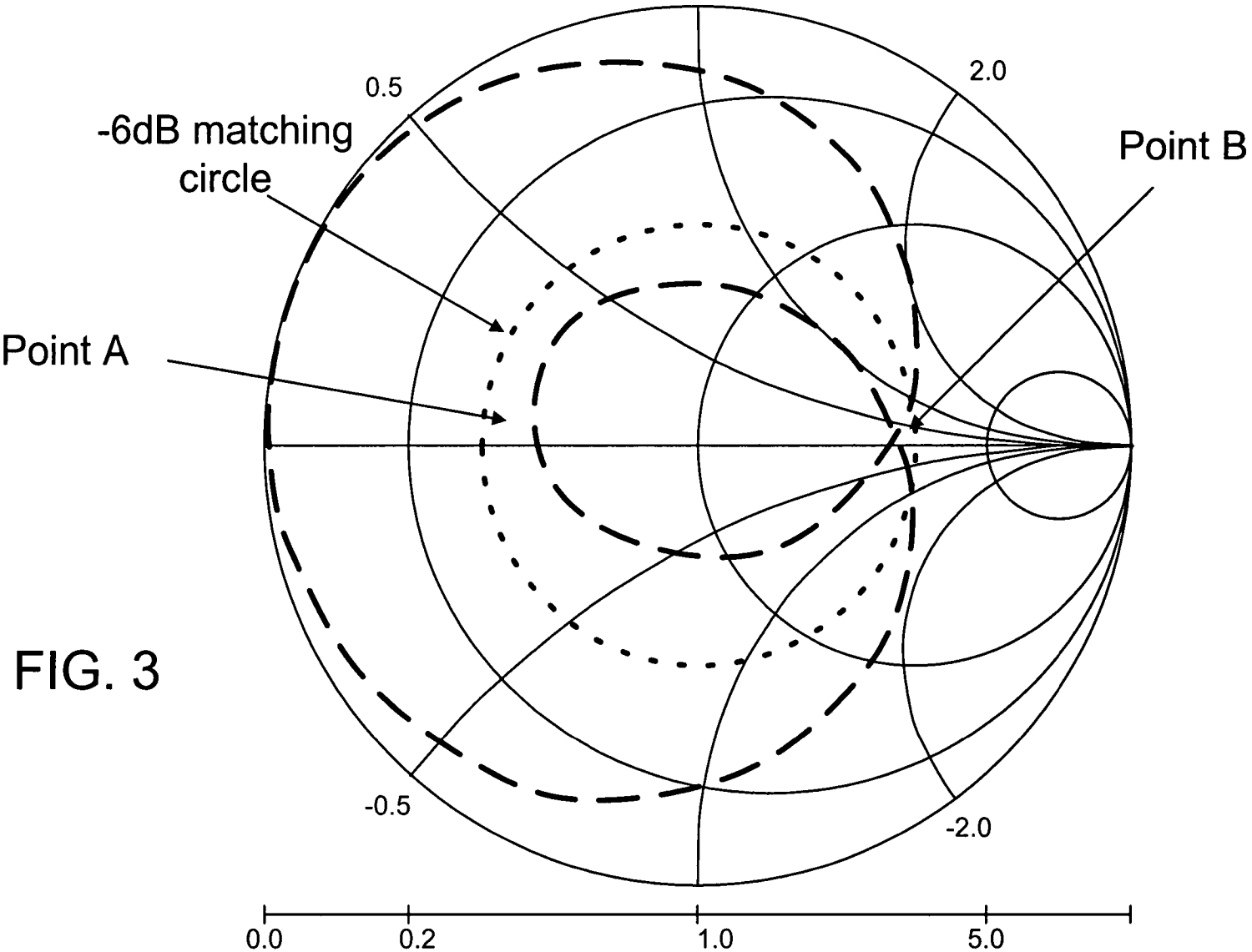
FIG. 3 shows a desired dual-resonant response plotted on a Smith Chart.

A conventional single-resonant PIFA type antenna (see FIG. 1*a*) has a low inherent bandwidth. A typical response of the PIFA type antenna is shown in FIG. 1*b*. It is possible to widen the bandwidth of a single-frequency, single-resonant PIFA type antenna by adding a parallel resonant network at the feed point of the PIFA, as shown in FIG. 2*a*. However, the PIFA must be modified to have about 20 ohms real impedance at the center frequency, as a simple resonance circuit cannot transform the impedance level of the antenna at the series-resonant frequency. This means that the impedance of the matched antenna on the series resonant (center) frequency is the same as the impedance of the antenna element itself on the series resonant frequency. This limits the use of a simple resonant circuit on an antenna element whose impedance level is moderate (~20 ohms) at the center frequency. A typical response of the modified PIFA plotted on a Smith Chart is shown in FIG. 2*b*. The desired dual-resonant response is shown in FIG. 3.

If a PIFA antenna is modified with a conventional parallel resonant matching network, the impedance of the antenna at the series resonance frequency is set by the PIFA itself as shown in FIG. 2*a*. Thus the PIFA itself must be designed to have a correct real impedance level at the desired center frequency. The parallel resonant network is then designed to have about the same resonant frequency as the desired center frequency of the antenna. The impedance level of the resonant circuit sets the location of the crossover point (shown as Point B in FIG. 3) on the Smith chart. A larger inductor together with a smaller capacitor would move the crossover point B to the right on the larger loop. Thus, in the PIFA case, once the antenna element itself is designed, only the crossover point may be moved by changing the matching network component values. Point A (center frequency matching) is fixed by the antenna.

It would be advantageous to devise a matching network with an impedance transforming property such that the impedance level of the antenna element at the series-resonant frequency can be arbitrary, either low (e.g. 5 ohm), moderate (e.g. 20 ohm) or high (e.g. 40 ohm), as compared to the desired impedance level of the antenna and the matching network combination. It would also be advantageous if this matching network could transform the antenna element impedance behavior to any value within a certain range desired by the designer in order to offer the maximum amount of bandwidth with a given input impedance behavior. For example, the resonant loop on the Smith Chart would always be within the desired Voltage Standing Wave Ratio (VSWR) criterion.

Figure 4A:
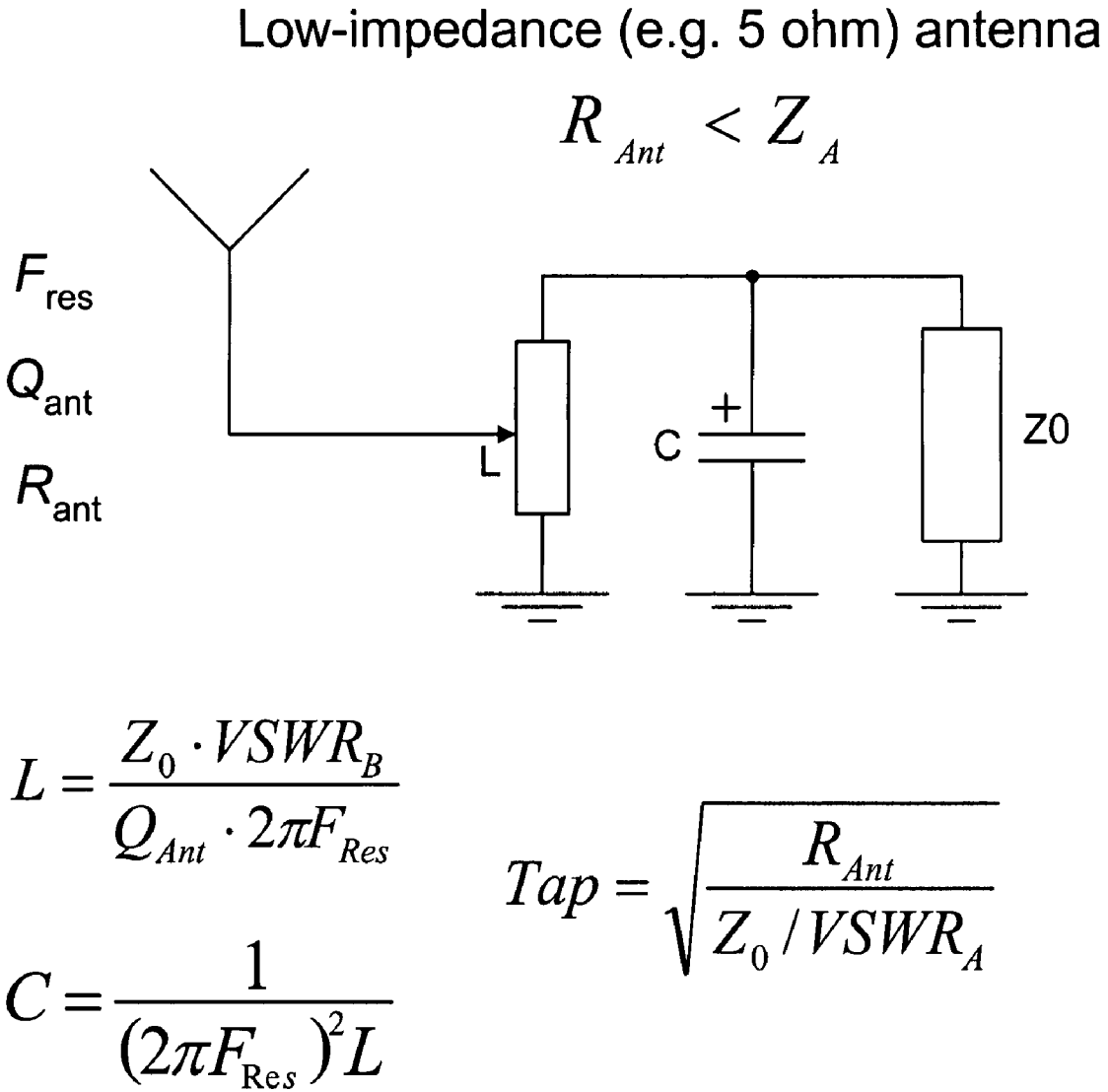
FIG. 4*a* shows an embodiment of the present invention.
Figure 4B:
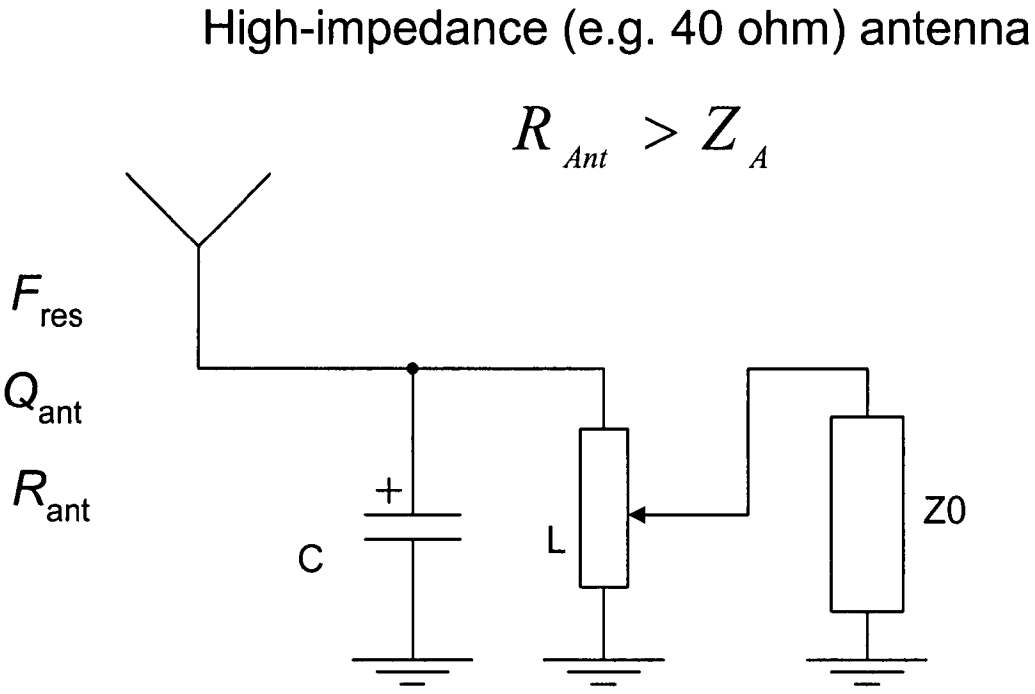
FIG. 4*b* shows another embodiment of the present invention.

Two such matching circuit topologies, according to the present invention, are shown in FIG. 4*a* and FIG. 4*b*. The matching network topology is selected based on the impedance level of the antenna element itself on the series-resonant frequency. If the antenna element is electrically lengthened or shortened by an additional series component (inductor, capacitor, transmission line), the impedance level at the new series resonant frequency determines the matching network topology.

Figure 5A:
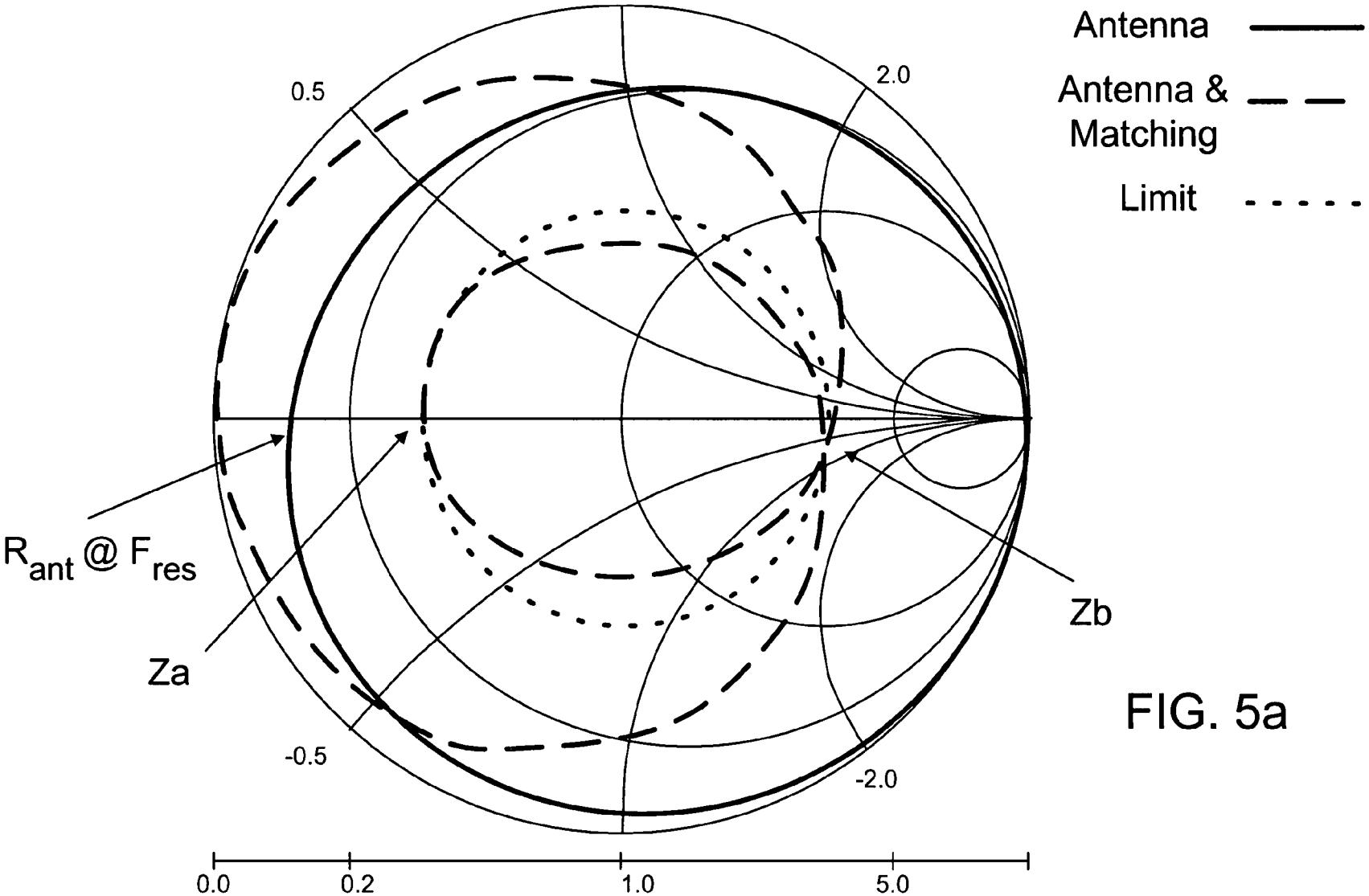
FIG. 5*a* shows a response of the antenna of FIG. 4*a* plotted on a Smith Chart.
Figure 5B:
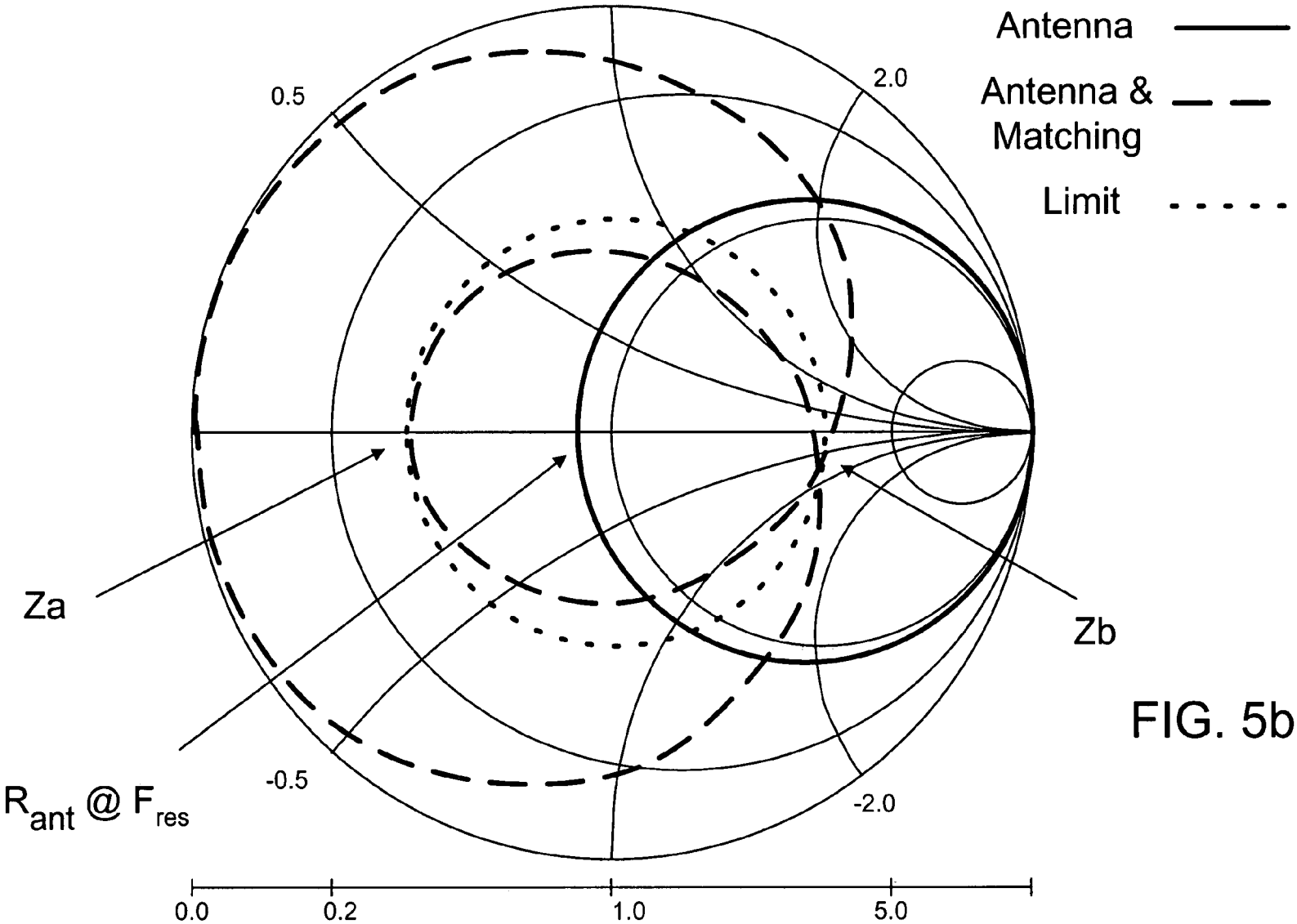
FIG. 5*b* shows a response of the antenna of FIG. 4*b* plotted on a Smith Chart.

As shown in FIGS. 4*a* and 4*b*, the inductance (L), the capacitor (C) in the matching network, and the tap position (Tap, between 0 and 1) are determined by the Q value of the antenna (Qant), the resistive part (Rant) of the antenna impedance, the resonant frequency (Fres) and the matching criteria ($VSWR_A$, $VSWR_B$). The Q value of the antenna element determines the achievable bandwidth of the matched antenna. In mobile phones with electrically small antennas the ground plane dimensions also affect the maximum achievable bandwidth. In practice the required capacitor value is smaller (about half) than calculated, due to small parasitic series inductance of practical capacitors. The responses of the antenna with the tapped-resonator matching network according to the embodiment as shown in FIGS. 4*a* and 4*b* are shown in FIGS. 5*a* and 5*b*, respectively.

In the tapped-resonator matching network antenna structure according to the present invention, there is an added degree of freedom in the matching network. The antenna is designed to have a series resonance (antenna length approximately equal to a quarter wavelength) at the desired center frequency. The antenna element can also be electrically lengthened or shortened by the addition of a series inductor, capacitor or transmission line. The impedance level of the antenna at the center frequency can be arbitrary. With the matching network, according to the invention, it would not be necessary to design the antenna impedance at the desired center frequency to be approximately 20 ohms. The modified matching network performs impedance level transformation at the center frequency in addition to forming the resonant loop. Now the added degree of freedom in the matching network may be used to control the location of the impedance at the center frequency (Point A in FIG. 3) in addition to the location of the crossover point (Point B in FIG. 3). This means that the shape and size of the resonant loop may be fully controlled by changing the values of the matching network components.

The preferred way to implement the matching network is to use a tapped inductor as shown in FIGS. 4*a* and 4*b*, but the tapped inductor can also be implemented as two separate inductors, because the mutual coupling the two parts of the inductor is insignificant. This center-tapped inductor can be made from a short length of a PWB line, for example. Typical value for this inductor is 2–3 nH for 1 GHz, corresponding to about 1×5 mm piece of PWB strip. The PWB strip can be implemented as a stripline or microstrip. As such, the location of the center tap can be used to set the mid-band matching (Point A). Moving the center tap closer to the ground end of the inductor (larger impedance) will move Point A to the right and vice versa. The total value of the inductor sets the crossover point B, but the capacitor value must be changed accordingly. Increasing the total inductance (and reducing the capacitor value at the same time) moves Point B to the right and vice versa.

By changing only the total inductance or the capacitor value rotates the crossover point around the center of the Smith chart. This provides a simple way to fine-tune the antenna impedance. It would also be possible to use a variable capacitor (varicap etc.) instead of the fixed capacitor in the matching network to be able to fine-tune the resonant loop location in real-time to compensate for the hand-effect, for example.

Figure 6A:
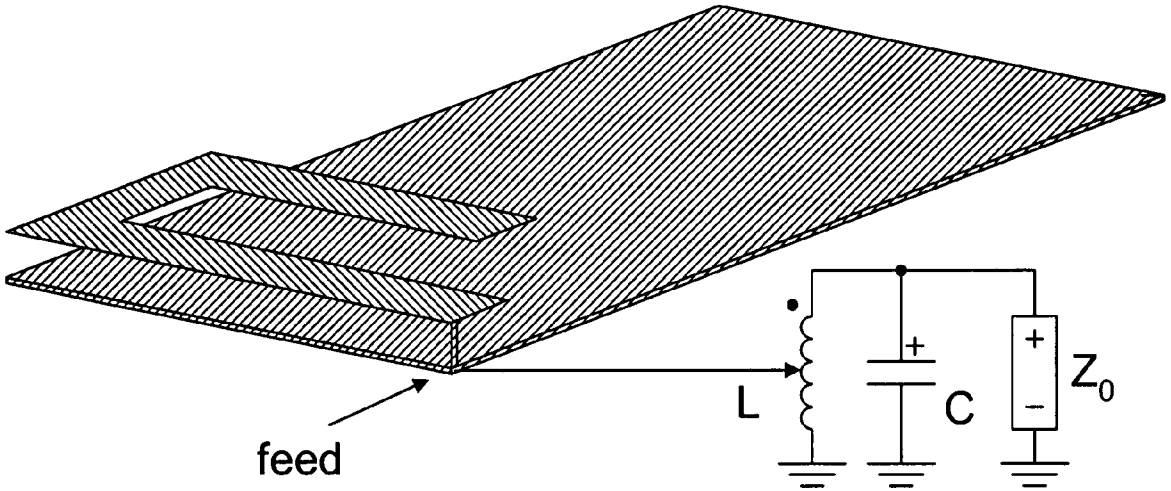
FIG. 6*a* shows a modified PILA with a tapped-resonator circuit for matching.
Figure 6B:
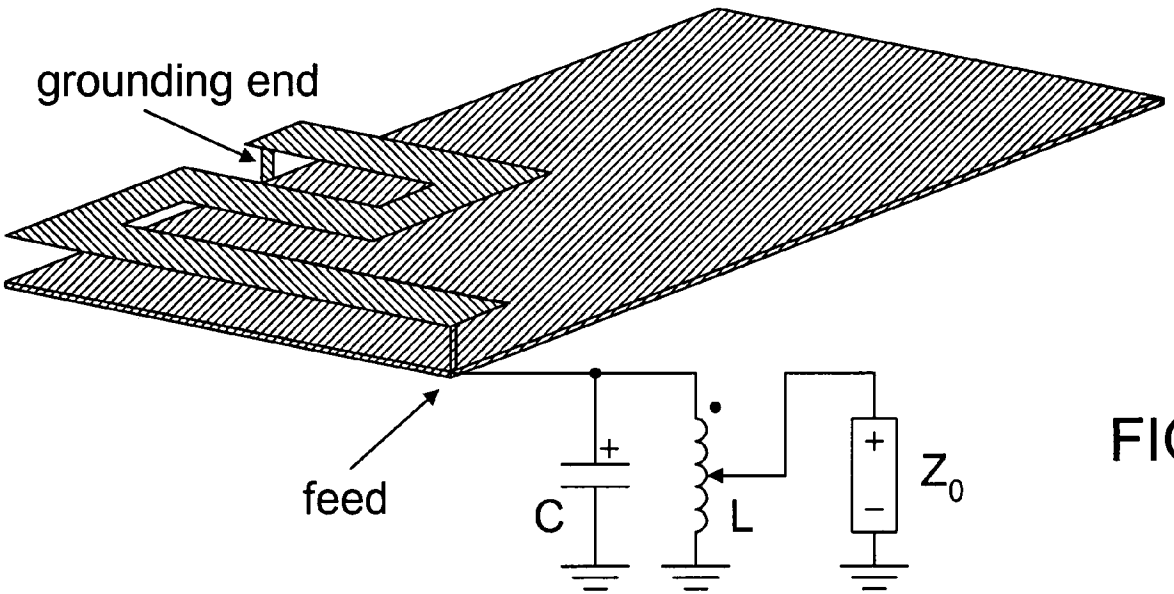
FIG. 6*b* shows a modified loop antenna with a different tapped-resonator circuit for matching.

The tapped-resonator matching network antenna structure, according to the present invention, is applicable to many different types of antennas. For example, the antenna can be a very low-impedance planar inverted-L antenna (PILA) that has only a single feed and no grounding pin. The antenna can also be a helix, monopole, whip, stub or loop antenna. The antenna can in fact be any type, but it needs to have a series-resonance on the center frequency. A modified PILA with a tapped-resonant circuit according to FIG. 4*a* is shown in FIG. 6*a*, and a modified loop antenna with a tapped-resonant circuit according to FIG. 4*b* is shown in FIG. 6*b*. As shown in FIG. 6*b*, the loop antenna has a feed at one end connected to the tapped-resonant circuit and a grounding pin at the other end.

It has been found that a quarter-wave PILA-type antenna (H=5 mm, strip width=5 mm, strip length=70 mm) with the center-tapped inductor and an 11 pF capacitor implemented on a 40×100 mm ground plane has a bandwidth of approximately 146 MHz (>−4 dB efficiency) covering 844 MHz to 990 MHz. The center-tapped inductor is implemented as a piece of 1.3×4.3 mm printed wired board (PWB) strip. The capacitor is soldered at the "open" end of the inductor together with the coax cable. The feed pin of the antenna was soldered approximately in the center of the PWB strip inductor.

Figure 7:
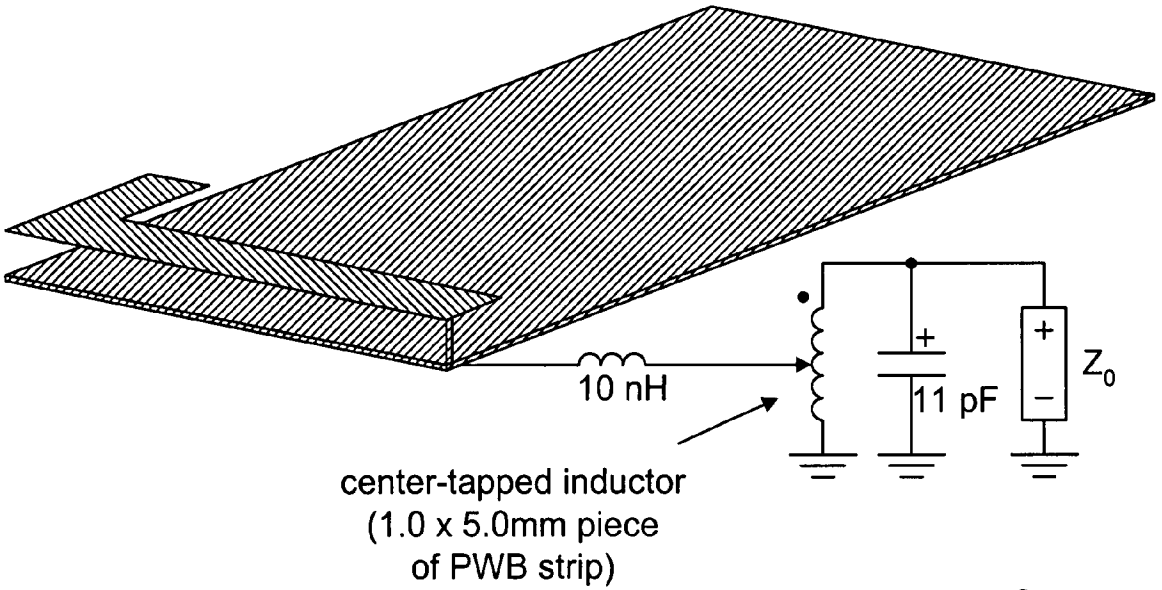
FIG. 7 shows another embodiment of the modified PILA.

It should be noted that the matching network shown in FIG. 6 can also be used with a shortened (<λ/4) PILA-type antenna (H=5 mm, strip width=5 mm and strip length=50 mm implemented on a 40×100 mm ground plane) for 850 and 900 bands. The PILA length less than λ/4 can be compensated for by the addition of a surface mount inductor, which also increases the bandwidth. The center-tapped inductor can be made of a 1.0×5.0 mm piece of PWB strip. It has been found that such a shortened PILA can have a bandwidth of 180 MHz (>−4 dB efficiency), covering 810 to 990 MHz. The shortened PILA is illustrated in FIG. 7.

Figure 8:
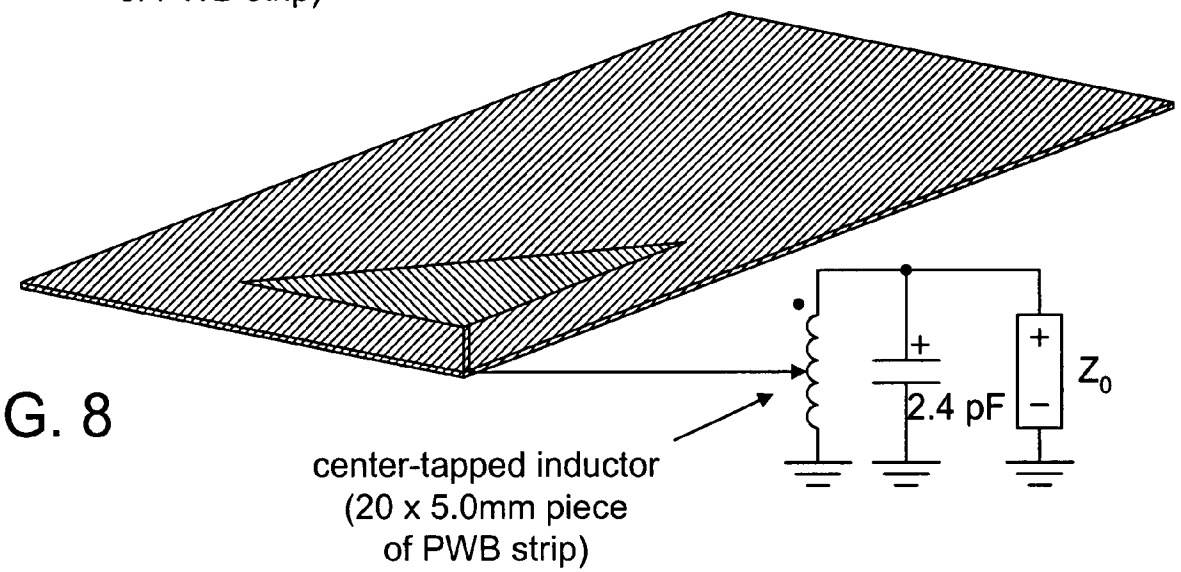
FIG. 8 shows yet another embodiment of the modified PILA.

A PILA-type antenna having a triangular radiating element (20×20 mm triangle with H=5 mm, implemented on a 40×100 mm ground plane), as shown in FIG. 8, can be used for 1800, 1900 and 2100 bands. The center-tapped inductor can be made of a 2.0×5.0 mm piece of PWB strip. The bandwidth of this triangular λ/4 PILA is approximately 460 MHz (>−2 dB efficiency), covering 1800 to 2260 MHz.

The matching network shown in FIGS. 4*a* and 4*b* can also be used on non-planar antennas. One possibility is an ILA-type antenna, where the planar structure of a PILA is replaced by a quarter-wavelength piece of wire on top of the ground plane. Another possibility is a monopole-type helix antenna, where the antenna is completely outside of the ground plane. Also a whip or stub type antenna can be used. In fact any arbitrary piece of metal can be used as an antenna, provided that it has a series resonance at the desired center frequency, it radiates sufficiently well and provides suitable SAR values. The antenna element can be electrically lengthened or shortened by the addition of a series inductor, capacitor or transmission line. This means that the natural series resonance of the antenna element can be somewhat higher or lower than desired center frequency.

The antenna element should be designed to have 5–20 ohm real impedance at the desired frequency in a matching arrangement as shown in FIG. 4*a*. However, when the matching components are arranged differently, as shown in FIG. 4*b*, the real impedance of the antenna can be much higher. For example, the antenna can be designed to have real impedance in the range of 30 to 45 ohm. As shown in FIG. 4*b*, the capacitor and the inductor are also connected in parallel, but the parallel connection is connected to the antenna in series. The center tap of the inductor is connected to an RF front-end having a load impedance so that the matching can be adjusted by the center tap. If the antenna element has a natural impedance on the series resonant frequency such that no impedance level transformation would be required, no center tap is required and the matching network topology reduces to a conventional parallel resonant LC circuit.

There are several ways to implement the matching network. It is possible to use all surface-mount device (SMD) components or low-temperature co-fired ceramic (LTCC) components. However, a piece of PWB strip on the motherboard as the resonator coils is an easier way to implement. A PWB strip with dimensions of 1 mm×5 mm has suitable inductance to implement the matching network for an 850 and 900 band PILA antenna. It would be possible to implement the tapped inductor with two SMD inductors, but controlling the tolerances would be very challenging. It would also be possible to implement the inductor as a piece of wire, as the required inductance is very small.

Figure 9A:
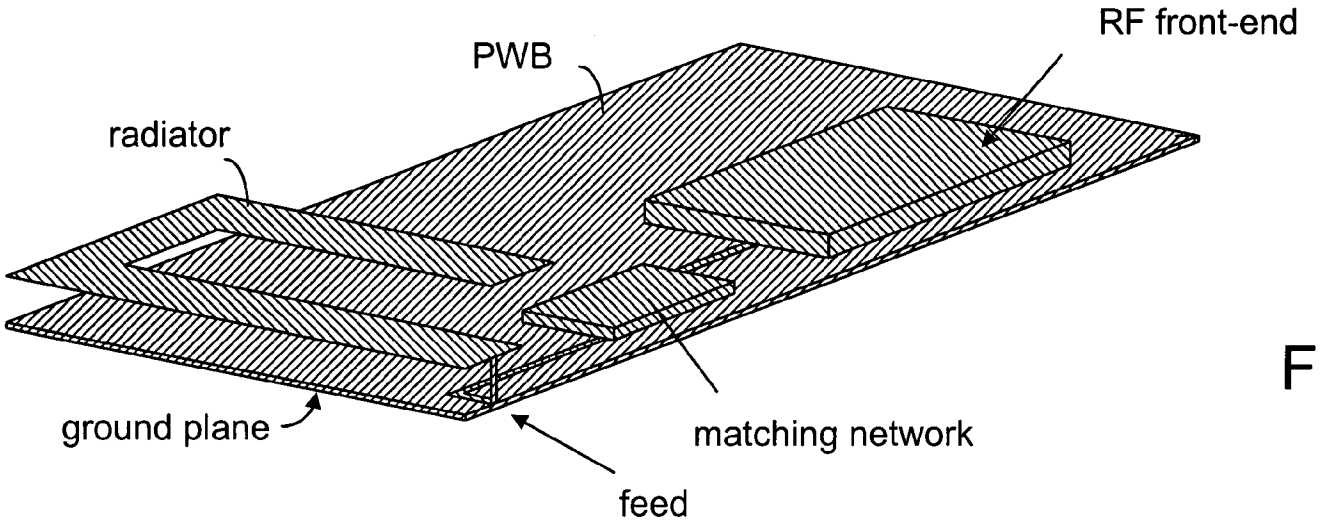
FIG. 9*a* shows a modified PILA wherein the radiator is separated from the circuit board carrying the matching network.
Figure 9B:
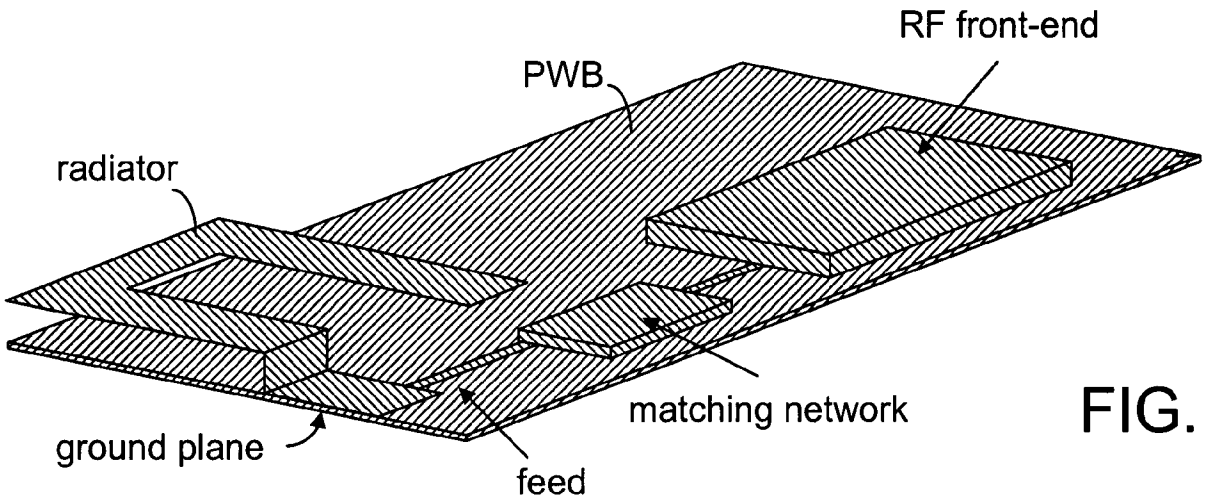
FIG. 9*b* shows a modified PILA wherein part of the radiator is located on the circuit board carrying the matching network.

Furthermore, the radiator of the antenna is not necessarily separated from the circuit board carrying the matching network as shown in 9*a*. Part of the antenna can be a strip on the circuit board, as shown in FIG. 9*b*. Thus, the strip on the circuit board can act as a part of the radiator or serve as a series transmission line or coil to shorten the antenna element. In FIGS. 9*a* and 9*b*, the matching network is electrically connected to a RF front end, which is disposed on the same circuit board. The matching network can have a number of discrete components mounted on the circuit board. The discrete components can be implemented in a chip. Alternatively, the components (capacitor, coil, strip) in the matching network can be integrated in a different substrate material, such as a low-temperature co-fired ceramic (LTCC) material which has low loss. For example, the LTCC module can be 2 mm×2 mm having a strip with tap and a capacitor on the module.

Figure 10:
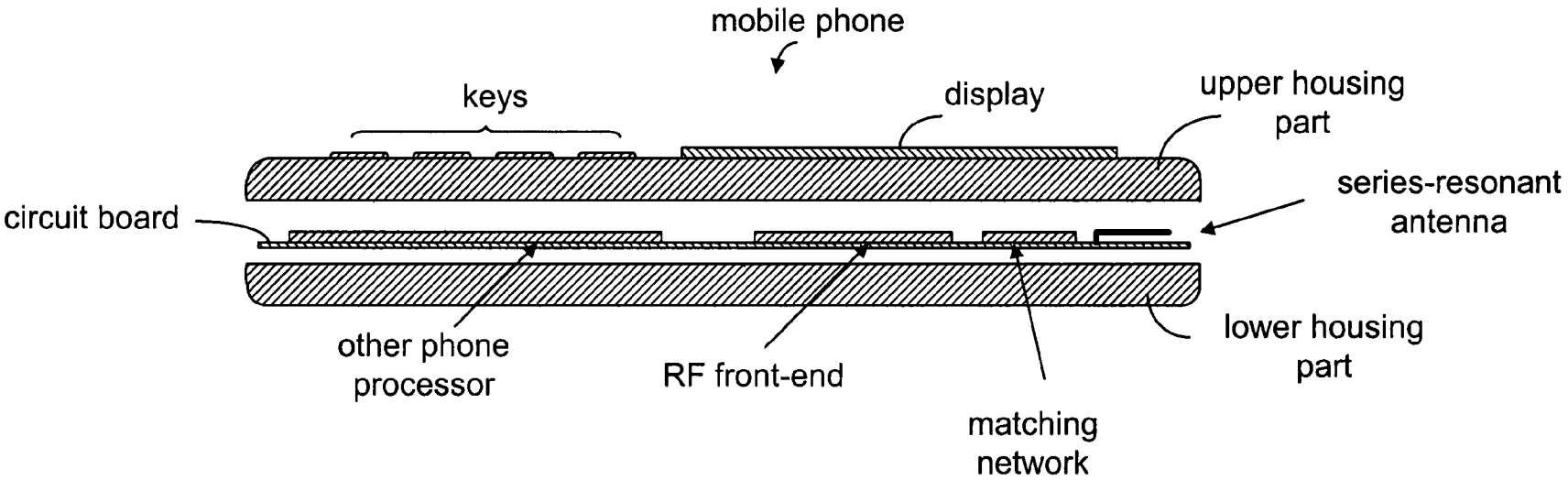
FIG. 10 is a schematic representation of a mobile terminal.

FIG. 10 is a schematic representation of a mobile phone having a wide-band antenna as shown in FIGS. 9*a* and 9*b*.

It is also seems that the input impedance of the antenna that uses the resonant matching circuit shown in this invention is somewhat less sensitive to the hand effect. The de-tuning of the antenna by hand or finger is more controlled, because the second resonance is fixed by the matching circuit and not the antenna itself as in conventional dual-resonant PIFA antennas.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. An antenna comprising:

a radiative element;

a feed pin electrically connected to the radiative element; and a matching network electrically connected to a ground plane, wherein the matching network comprises:

an inductive element electrically connected to the feed pin; and a capacitor connected in parallel to the inductive element, wherein the inductive element has a center tap for determining impedance of the matching network relative to impedance of the antenna.

2. The antenna of claim 1, wherein the feed pin has a first end and a second end, the first end electrically connected to the radiative element, the second end electrically connected to the center tap of the inductive element.

3. The antenna of claim 1, wherein the antenna is operatively connected to a front-end, and wherein the matching network is connected in series to the feed pin and the center tap of the inductive element is connected to the front-end.

4. The antenna of claim 1, wherein the antenna has a center frequency and the radiative element comprises a planar strip of electrically conductive material, the strip having a surface substantially parallel to the ground plane.

5. The antenna of claim 4, wherein the strip has a length substantially equal to one quarter of a wavelength associated with the center frequency.

6. The antenna of claim 4, wherein the strip has a length smaller than one quarter of a wavelength associated with the center frequency, said antenna further comprising:

a further inductive element disposed between the center tap and the second end of the feed pin.

7. The antenna of claim 1, wherein the radiative element comprises a triangular strip of electrically conductive material, the strip having a surface substantially parallel to the ground plane.

8. The antenna of claim 1, wherein the matching network is disposed on a circuit board, and wherein the radiative element comprises a strip of electrically conductive material and part of the strip is disposed on the circuit board.

9. The antenna of claim 1, wherein the radiative element comprises a planar strip having a first end and an opposing second end, and wherein the feed pin is electrically connected to the first end of the planar strip, said antenna further comprising a grounding strip connecting the second end of the planar strip to the ground.

10. The antenna of claim 1, wherein the antenna impedance is smaller than 50 ohms.

11. An antenna system comprising:

a circuit board with a ground plane;

an antenna having an antenna impedance disposed in relation to the circuit board, the antenna comprising:

a radiative element;

a feed pin electrically connected to the radiative element; and a matching network electrically connected to the ground plane, wherein the matching network comprises:

an inductive element electrically connected to the feed pin; and a capacitor connected in parallel to the inductive element, wherein the inductive element has a center tap for determining impedance of the matching network relative to the antenna impedance; and an RF front-end operatively connected to the antenna.

12. The antenna system of claim 11, wherein the feed pin has a first end and a second end, the first end electrically connected to the radiative element, the second end electrically connected to the center tap of the inductive element.

13. The antenna system of claim 11, wherein the matching network is connected in series to the feed pin and the center tap of the inductive element is connected to the front-end.

14. The antenna system of claim 11, wherein the matching network is integrated in a substrate different from the circuit board.

15. The antenna system of claim 14, wherein the substrate is made substantially of a low-temperature co-fire ceramic material.

16. The antenna system of claim 15, wherein the substrate forms a module, and the inductive element comprises a strip of electrically conductive material disposed on the module.

17. The antenna system of claim 16, wherein the capacitor is also disposed on the module.

18. The antenna system of claim 11, wherein the antenna has a center frequency and the radiative element comprises a planar strip of electrically conductive material, the strip having a surface substantially parallel to the ground plane.

19. The antenna system of claim 18, wherein the strip has a length smaller than one quarter of a wavelength associated with the center frequency, said antenna further comprising:

a further inductive element disposed between the center tap and the second end of the feed pin.

20. The antenna system of claim 19, wherein the matching network and the further inductive element are integrated in a substrate made substantially of a low-temperature co-fired ceramic material.

21. A mobile phone having a wide-band antenna system of claim 11.

22. A method to increase a bandwidth of an antenna having an antenna impedance for use with a ground plane and electrically connected to an RF front-end, the RF front-end having a load impedance, the antenna having a radiative element disposed in relationship with the ground plane;

a feed pin electrically connected to the radiative element, said method comprising:

providing a matching network between the antenna and the RF front-end, the network having an inductive element and a capacitor connected in series, the inductive element having a center tap; and electrically connecting the center tap to the feed pin or the RF front-end for adjusting the matching network relative to the antenna impedance.

* * * * *